US009821358B2

(12) United States Patent
Kawashima et al.

(10) Patent No.: US 9,821,358 B2
(45) Date of Patent: Nov. 21, 2017

(54) METHOD AND APPARATUS FOR FORMING ELLIPTICAL HOLLOW CYLINDER

(71) Applicant: CALSONIC KANSEI CORPORATION, Saitama-shi, Saitama (JP)

(72) Inventors: Dai Kawashima, Saitama (JP); Shinji Hioki, Saitama (JP); Shuji Tokita, Saitama (JP)

(73) Assignee: CALSONIC KANSEI CORPORATION, Saitama (JP)

( * ) Notice: Subject to any disclaimer, the term of this patent is extended or adjusted under 35 U.S.C. 154(b) by 0 days.

(21) Appl. No.: 15/103,350

(22) PCT Filed: Dec. 3, 2014

(86) PCT No.: PCT/JP2014/081953
§ 371 (c)(1),
(2) Date: Jun. 10, 2016

(87) PCT Pub. No.: WO2015/087752
PCT Pub. Date: Jun. 18, 2015

(65) Prior Publication Data

US 2016/0325332 A1 Nov. 10, 2016

(30) Foreign Application Priority Data

Dec. 12, 2013 (JP) ..... 2013-256630
Dec. 25, 2013 (JP) ..... 2013-266927

(51) Int. Cl.
*B21D 22/14* (2006.01)
*B21D 41/04* (2006.01)

(52) U.S. Cl.
CPC ..... *B21D 22/14* (2013.01); *B21D 41/04* (2013.01)

(58) Field of Classification Search
CPC ..... B21D 22/14; B21D 22/16; B21D 22/18; B21D 41/04
See application file for complete search history.

(56) References Cited

U.S. PATENT DOCUMENTS 4,170,889 A * 10/1979 Tanimoto ..... B21D 22/185 72/83
2004/0011105 A1 1/2004 Nakamura
(Continued)

FOREIGN PATENT DOCUMENTS

CN 101274347 A 10/2008
CN 101954401 A 1/2011
(Continued)

*Primary Examiner* — Teresa M Ekiert
(74) *Attorney, Agent, or Firm* — Foley & Lardner LLP

(57) ABSTRACT

According to a method for forming an elliptical hollow cylinder, part of the elliptical hollow cylinder is formed into a circular hollow cylindrical shape by spinning. The forming method includes a first forming process for forming the part of the elliptical hollow cylinder into a circular hollow cylindrical shape by using an inside roller, and a second forming process for reducing a diameter of the part formed into the circular hollow cylindrical shape in the first forming process by using an outside roller. According to the forming method, it becomes possible to shorten time required for forming the part of the elliptical hollow cylinder into a circular hollow cylindrical shape by spinning.

13 Claims, 11 Drawing Sheets

(56) References Cited

U.S. PATENT DOCUMENTS

| | | | | |
|---|---|---|---|---|
| 2008/0314113 | A1 | 12/2008 | Minoguchi | |
| 2012/0216590 | A1 | 8/2012 | Szuba | |
| 2013/0152652 | A1* | 6/2013 | Allwood ..... | B21D 22/16 72/85 |

FOREIGN PATENT DOCUMENTS

| | | | |
|---|---|---|---|
| JP | 63-309333 | A | 12/1988 |
| JP | H05-226 | U | 1/1993 |
| JP | 2000-246353 | A | 9/2000 |
| JP | 2002-066665 | A | 3/2002 |
| JP | 2003-230917 | A | 8/2003 |
| JP | 3855789 | B | 12/2006 |

* cited by examiner (a)

PRIOR ART (b)

PRIOR ART

METHOD AND APPARATUS FOR FORMING ELLIPTICAL HOLLOW CYLINDER

TECHNICAL FIELD

The present invention relates to a method and an apparatus for forming an elliptical hollow cylinder, especially to those for forming part of an elliptical hollow cylinder into a circular hollow cylindrical shape.

BACKGROUND ART

Heretofore, as shown in FIG. 11(*a*), in a case for reducing a diameter an end portion of an elliptical hollow cylinder (a workpiece) 301 by spinning to form it into a circular hollow cylindrical shape, rollers 303 are contacted with the elliptical hollow cylinder 301 from outside.

However, according to this forming method, the rollers 303 cannot follow a shape of the elliptical hollow cylinder 301, and thereby the rollers 303 spin freely at short-diameter portions (see FIG. 11(*b*)). Namely, since a distance between a rotational axis of the elliptical hollow cylinder 301 and a rotational axis of the roller(s) 303 cannot be changed quickly, the roller(s) 303 contacts only with long-diameter portions and spins freely without contacting with the short-diameter portions.

If a rotational speed of the elliptical hollow cylinder 301 is made slow in order to make the rollers 303 capable of following the shape of the elliptical hollow cylinder 301, it takes more time for diameter reduction of the elliptical hollow cylinder 301 by spinning and thereby mass production becomes difficult. Therefore, a forming method for shortening time required for the diameter reduction of the end portion of the elliptical hollow cylinder 301 is proposed (see a Patent Document 1 listed below).

In the forming method disclosed in the Patent Document 1, first, a die (mandrel) 305 is inserted into an end portion 309 of an elliptical hollow cylinder 301 shown in FIG. 12, and the end portion 309 of the elliptical hollow cylinder 301 is formed into a circular hollow cylindrical shape as shown in FIG. 13. Then, as shown in FIG. 14, a diameter of the end portion 309 formed into a circular hollow cylindrical shape is reduced by spinning with a roller 307 to form a small-diameter end portion 309*a*.

PRIOR ART DOCUMENT

Patent Documents

Patent Document 1: Japanese Patent Application Publication No. 2002-66665

SUMMARY OF INVENTION

According to the forming method disclosed in the Patent Document 1, forming time of the end portion 309 can be shortened to a certain extent, but time for transferring the elliptical hollow cylinder 301 must be required between the process with the die 305 and the spinning process. Therefore, it takes time to reduce a diameter of the end portion 309 after all.

An object of the present invention is to provide a method and an apparatus for forming an elliptical hollow cylinder that can shorten time required for forming part of an elliptical hollow cylinder into a circular hollow cylindrical shape. Note that a term "elliptical" used here doesn't mean only a precise mathematical ellipse, but also includes an oval and so on.

A first aspect of the present invention provides a method for forming an elliptical hollow cylinder, by which part of the elliptical hollow cylinder is formed into a circular hollow cylindrical shape by spinning, the method comprising: a first forming process for forming the part of the elliptical hollow cylinder into a circular hollow cylindrical shape by using an inside roller; and a second forming process for reducing a diameter of the part formed into the circular hollow cylindrical shape in the first forming process by using an outside roller.

It is preferable that the part of the elliptical hollow cylinder is an end portion of the elliptical hollow cylinder, and the inside roller has a portion that forms a boundary portion between the end portion and a portion other than the end portion so as to be smoothly curved.

It is preferable that the second forming process is done in parallel with the first forming process.

It is preferable that the outside roller is used in the first forming process in addition to the inside roller to form the part of the elliptical hollow cylinder into a circular hollow cylindrical shape by using the inside roller and the outside roller concurrently.

It is preferable that, in the first forming process, the inside roller and the outside roller are moved along an axial direction of the elliptical hollow cylinder, and form short-diameter portions of the elliptical hollow cylinder and vicinities of the short-diameter portions into a circular hollow cylindrical shape.

It is preferable that the outside roller is provided in a single equipment in, which the inside roller is also provided, and the first forming process and the second forming process are done in the single equipment.

It is preferable that the inside roller is longer than the outside roller.

It is preferable that a processed area by the outside roller in the second forming process is longer than a processed area by the inside roller in the first forming process.

A second aspect of the present invention provides an apparatus for forming an elliptical hollow cylinder, by which part of the elliptical hollow cylinder is formed into a circular hollow cylindrical shape by spinning, the apparatus comprising: an inside roller that is located inside the elliptical hollow cylinder, and forms the part of the elliptical hollow cylinder into a circular hollow cylindrical shape; and an outside roller that is located outside the elliptical hollow cylinder, and reduces a diameter of the part formed into the circular hollow cylindrical shape by the inside roller.

It is preferable that the part of the elliptical hollow cylinder is an end portion of the elliptical hollow cylinder, and the inside roller has a portion that forms a boundary portion between the end portion and a portion other than the end portion so as to be smoothly curved.

It is preferable that the outside roller and the inside roller are disposed along an axial direction of the elliptical hollow cylinder, and moved in the axial direction at the same speed while keeping a constant distance therebetween.

It is preferable that, when the inside roller forms the part of the elliptical hollow cylinder into a circular hollow cylindrical shape, also the outside roller forms the part of the elliptical hollow cylinder into the circular hollow cylindrical shape.

It is preferable that the inside roller and the outside roller are movable along an axial direction of the elliptical hollow cylinder, and form short-diameter portions of the elliptical hollow cylinder and vicinities of the short-diameter portions into a circular hollow cylindrical shape.

It is preferable that the inside roller is longer than the outside roller.

It is preferable that a processed area by the outside roller is longer than a processed area by the inside roller.

DESCRIPTION OF EMBODIMENTS

Figure 1:
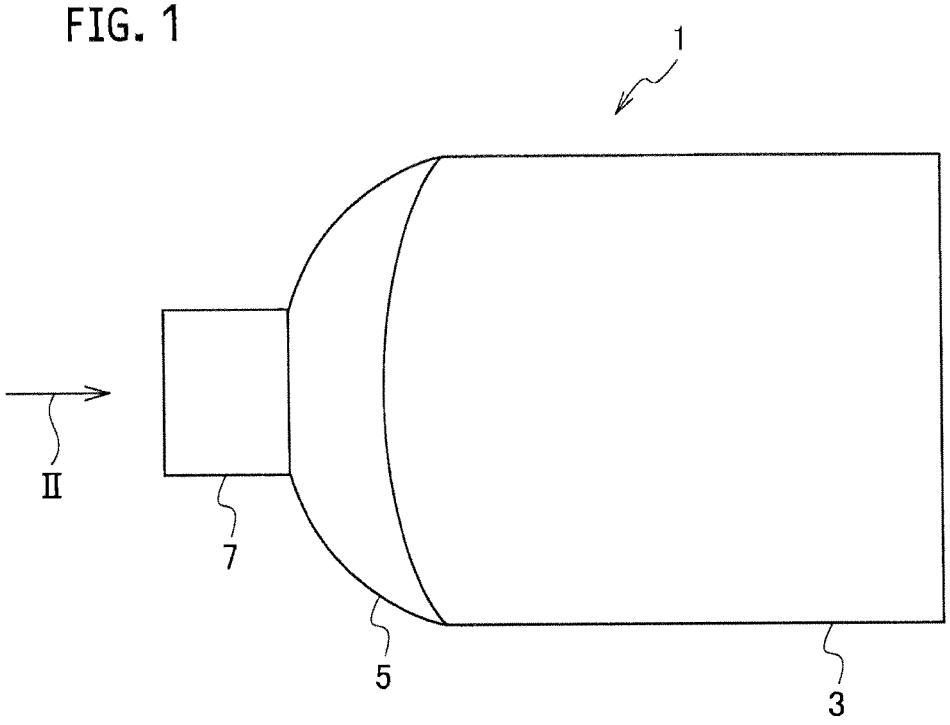
FIG. 1 It is a side view of a product (semi-finished product) formed by a method for forming an elliptical hollow cylinder according to a first embodiment.
Figure 2:
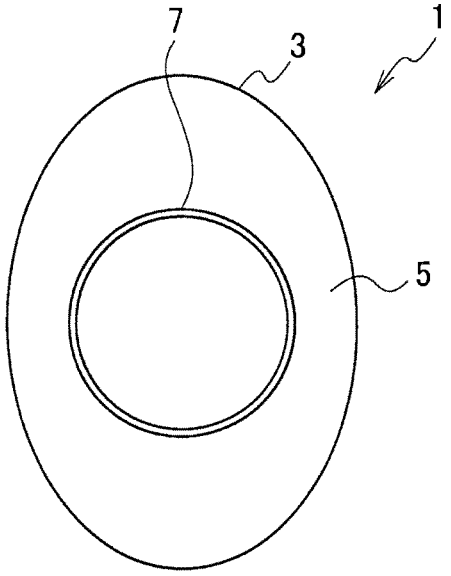
FIG. 2 It is a front view viewed along an arrow II shown in FIG. 1.

A product (semi-finished product) 1 that is formed by a method for forming an elliptical hollow cylinder according to a first embodiment is used in an exhaust gas converter, an exhaust muffler or the like for an automobile eventually, for example. As shown in FIG. 1 and FIG. 2, the product 1 includes a main body 3, an intermediary portion 5 and an end portion 7, and is formed so as to have a hollow cylindrical shape.

Figure 4:
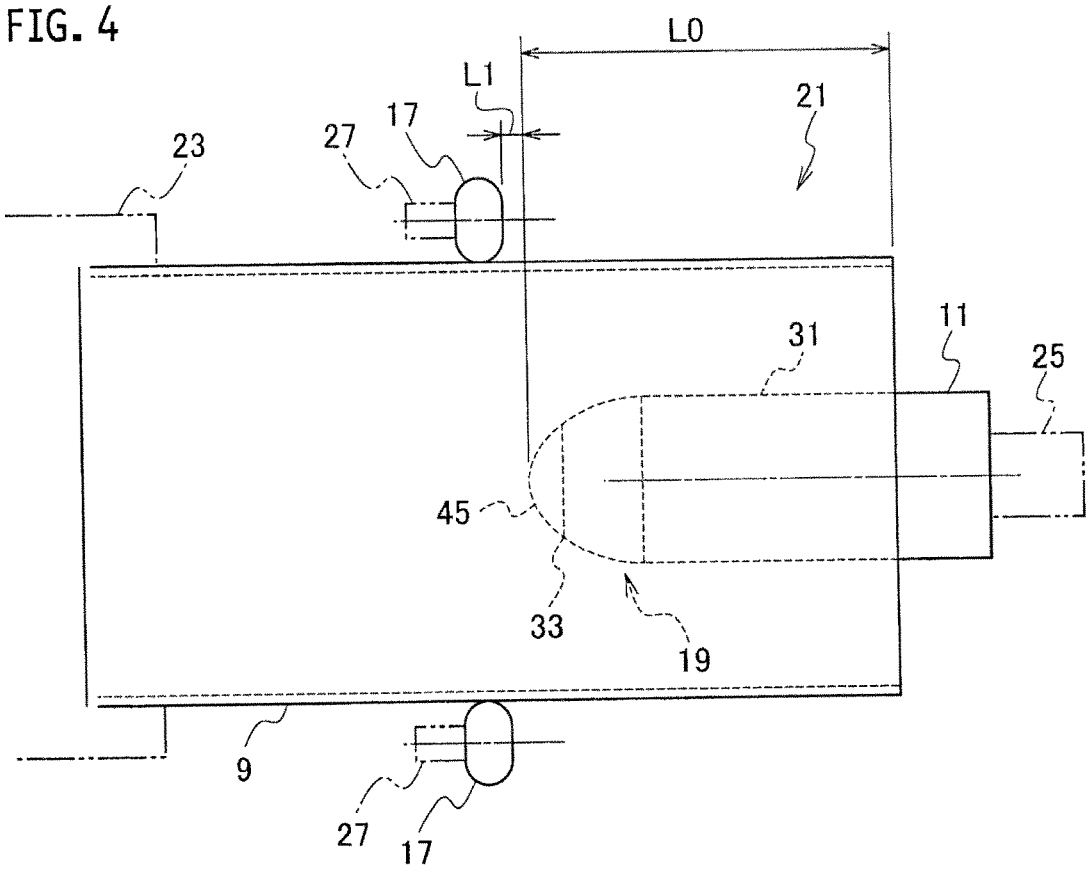
FIG. 4 It is a side view viewed along an arrow IV shown in FIG. 3.
Figure 5:
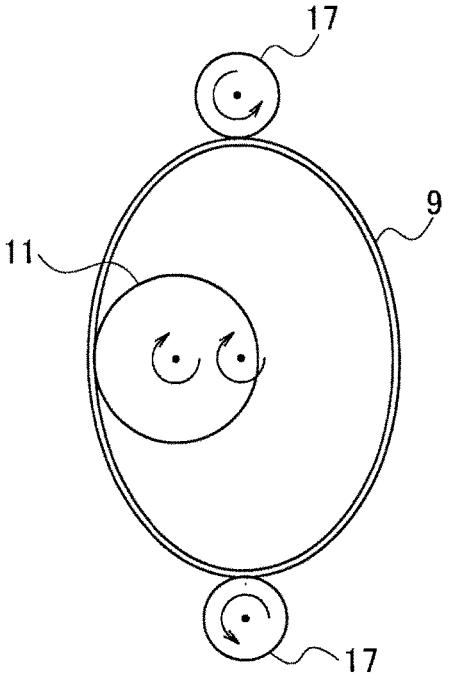
FIG. 5 It is a side view viewed along an arrow V shown in FIG. 3.

The product 1 is manufactured by forming an end portion of an elliptical hollow cylinder (a hollow cylinder having an elliptical cross-sectional shape perpendicular to a center axis) 9 as shown in FIG. 4 and FIG. 5 into a circular hollow cylindrical shape (a hollow cylinder having an almost precise circular cross-sectional shape perpendicular to the center axis) by spinning.

The main body 3 keeps the shape of the elliptical hollow cylinder 9. The end portion 7 is formed as a circular hollow cylinder portion that has an outer diameter smaller than a short diameter (an inner diameter) of the main body 3. The intermediary portion 5 is formed between the main body 3 and the end portion 7. A cross-sectional shape (a shape of a cross-section perpendicular to the center axis) of the intermediary portion 5 gradually changes from the main body 3 toward the end portion 7 so as to shift from a cross-sectional shape of the main body 3 to a cross-sectional shape of the end portion 7. In addition, a center axis of the main body 3, a center axis of the intermediary portion 5 and a center portion of the end portion 7 are coincident with each other. Hereinafter, a direction of the center axis(es) is referred as an axial direction.

Figure 6:
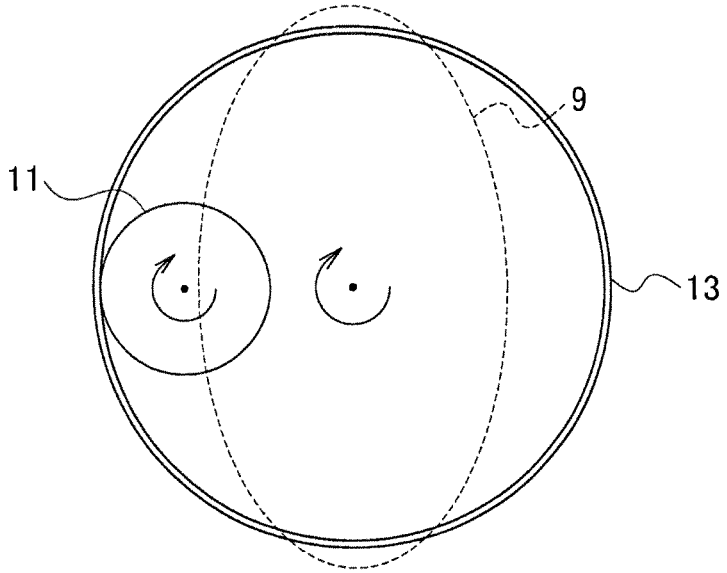
FIG. 6 It is a front view showing a first forming process in the method.

An overview of a forming method of the product 1 will be described. First, as shown in FIG. 6, the end portion of the elliptical hollow cylinder 9 is formed into an (almost) circular hollow cylindrical shape by an inside roller 11 (a first forming process). By the first forming process, a large-diameter circular hollow cylindrical portion 13 is formed at the end portion of the elliptical hollow cylinder 9.

In the present embodiment, an outer diameter of the large-diameter circular hollow cylindrical portion 13 is smaller than a long diameter (an inner diameter) of the elliptical hollow cylinder 9, and larger than a short diameter (an outer diameter) of the elliptical hollow cylinder 9. However, the outer diameter of the large-diameter circular hollow cylindrical portion 13 may be made larger than a large diameter (an inner diameter or an outer diameter) of the elliptical hollow cylinder 9. Subsequently, as shown in FIG. 7, a diameter of the large-diameter circular hollow cylindrical portion 13 is reduced by a pair of outside rollers 17 to form the end portion (a second forming process).

Figure 7:
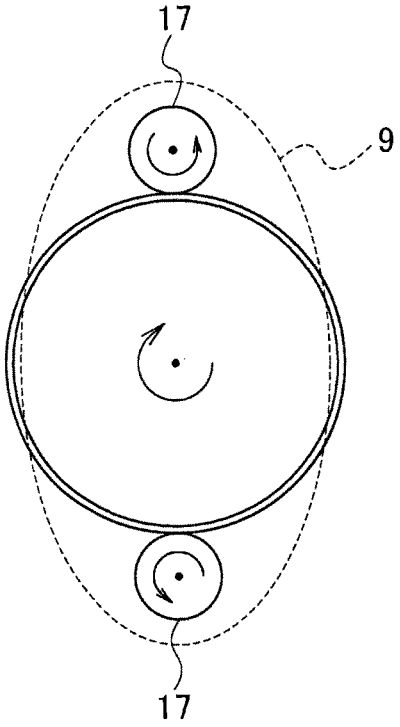
FIG. 7 It is a front view showing a second forming process in the method.
Figure 8:
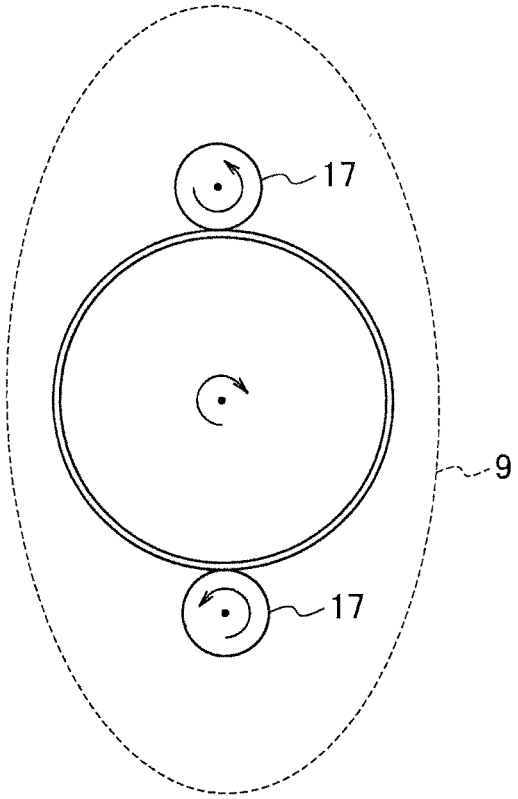
FIG. 8 It is another front view showing the second forming process in the method.

In a state shown in FIG. 7, an outer diameter of the end portion is smaller than the long diameter (an inner diameter) of the elliptical hollow cylinder 9, and larger than the short diameter (an outer diameter) of the elliptical hollow cylinder 9. However, if the outside rollers 17 continue spinning, a product 1 having an end portion 7 whose outer diameter is smaller the short diameter (an inner diameter or an outer diameter) of the elliptical hollow cylinder 9 may be manufactured (see FIG. 1, FIG. 2 and FIG. 8). Note that the outer diameter of the end portion 7 is smaller than the short diameter (an inner diameter) of the elliptical hollow cylinder 9 (a state shown in FIG. 8), but may be smaller than the long diameter (an inner diameter) of the elliptical hollow cylinder 9 and larger than the short diameter (an outer diameter) thereof (a state shown in FIG. 7). In addition, although it will be described later, the second forming process is done in parallel with the first forming process in the present embodiment (the second forming process is done sequentially to the first forming process).

As shown in FIG. 4, one end (a right end) of the inside roller 11 is attached to an after-described inside roller mount portion 25. Before the first forming process, another end (a left end) of the inside roller 11 is distanced from one end (a right end) of the elliptical hollow cylinder 9 along the above-mentioned axial direction by a predetermined length L0 toward a side of another end (a left end) thereof. In addition, one end (a right end) of the outside roller(s) 17 is distanced from the other end (left end) of the inside roller 11 along the axial direction by a predetermined length L1. Namely, the outside rollers 17 are located on a side of the other end (a left side) of the inside roller 11.

In the first forming process, in a state where the elliptical hollow cylinder 9 is being rotated about the center axis, the inside roller 11 is moved toward a side of the one end (a right side) in the axial direction while being contacted onto an inner wall of the elliptical hollow cylinder 9. By the first forming process, the large-diameter circular hollow cylindrical portion 13 is formed. In the second forming process, in a state where the elliptical hollow cylinder 9 is being rotated about the center axis, the outside rollers 17 are moved toward the side of the one end (right side) in the axial direction while being contacted onto an outer wall of the large-diameter circular hollow cylindrical portion 13. By the second forming process, the intermediary portion 5 and the end portion 7 are formed. Here, the outside rollers 17 move at almost the same speed as that of the inside roller 11, and follow the inside roller 11 while keeping the distance L1 to the inside roller 11 substantially constant.

A processed area, along the axial direction, by the outside rollers 17 in the second forming process is longer than a processed area by the inside roller 11 in the first forming process. Therefore, the intermediary portion 5 is formed to have a precise shape.

The outside rollers 17 are provided in a single equipment (an equipment used for spinning: a forming apparatus) 21 in which the inside roller 11 is also provided. The first forming process and the second forming process are done by the forming apparatus 21. In addition, the inside roller 11 is longer than the outside rollers 17.

Before the first forming process, the other end (left end) of the inside roller 11 is distanced from the one end (right end) of the elliptical hollow cylinder 9 along the axial direction by the predetermined length L0 toward the side of the other end (left end) thereof. In addition, the one end (right end) of the inside roller 11 is slightly protruded out from the one end (right end) of the elliptical hollow cylinder 9 along the axial direction. Therefore, part (most part of a side of the other end) of the inside roller 11 is remained in an inside of the elliptical hollow cylinder 9. Note that an entire of the elliptical hollow cylinder 9 may be remained in the inside of the elliptical hollow cylinder 9 so as not to protrude the one end of the inside roller 11 out from the inside of the elliptical hollow cylinder 9.

A length (length along the axial direction) of the outside roller(s) 17 is shorter than a length (length along the axial direction) of the inside roller 11. Note that the inside roller 11 may have almost the same length as that of the outside roller(s) 17 by being shortened. Also in this case, the predetermined length L1 in the first forming process is maintained.

Next, a shape of the inside roller 11 in the present embodiment will be described in detail. The inside roller 11 has a shape that prevents generation of defects on a product 1. For example, according to the forming method disclosed in the above Patent Document 1 that uses the die (mandrel) 305 (see FIG. 12 to FIG. 14), there may be a case where a ridge line of the die 305 is transferred to the elliptical hollow cylinder 301, and a transferred mark of the ridge line 315 (e.g. a dent) remains on a product 1 as a defect.

Figure 12:
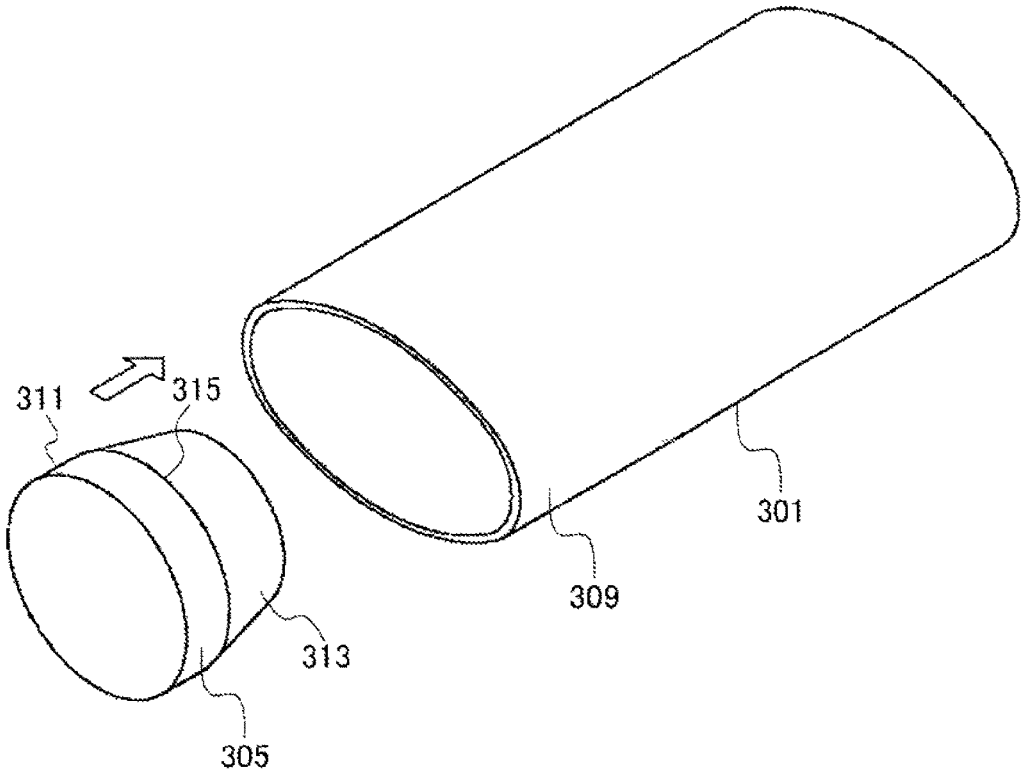
PRIOR ART FIG. 12
FIG. 12 It is a perspective view showing another prior-art forming method (before forming).
Figure 13:
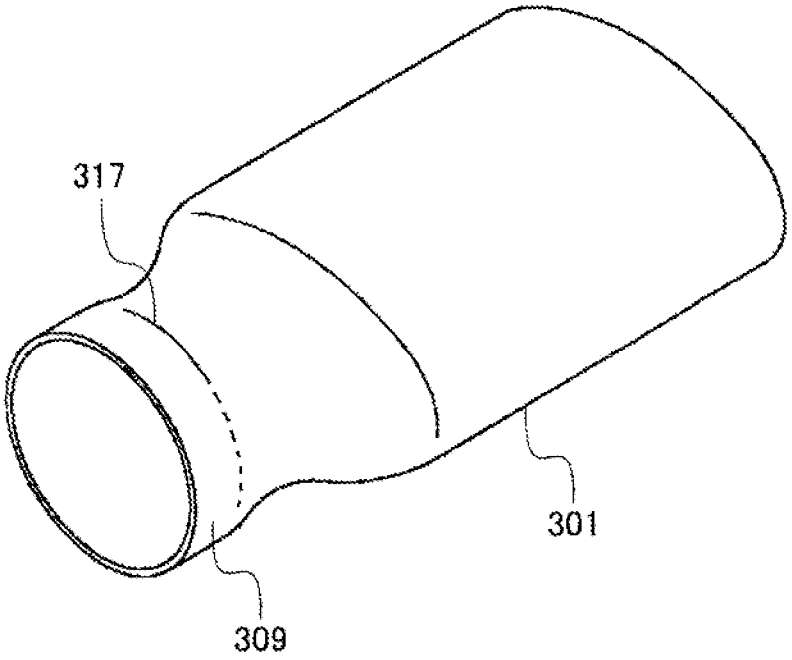
PRIOR ART FIG. 13
FIG. 13 It is a perspective view showing the other forming method (during forming).

As shown in FIG. 12, the ridge line 315 is formed on a boundary between a solid cylindrical main body 311 and a truncated-cone shaped end portion 313 of the die 305. As shown in FIG. 13, when the end portion 309 of the elliptical hollow cylinder 301 is formed into a circular hollow cylindrical shape by inserting the die 305 into the end portion 309 of the elliptical hollow cylinder 301, the ridge line 315 is transferred and thereby a ridge line 317 is also formed on the end portion 309. Here, necking (e.g. a dent) may be generated by the ridge line 317. The ridge line 317 is generated markedly at the short-diameter portions of the elliptical hollow cylinder 301.

Figure 14:
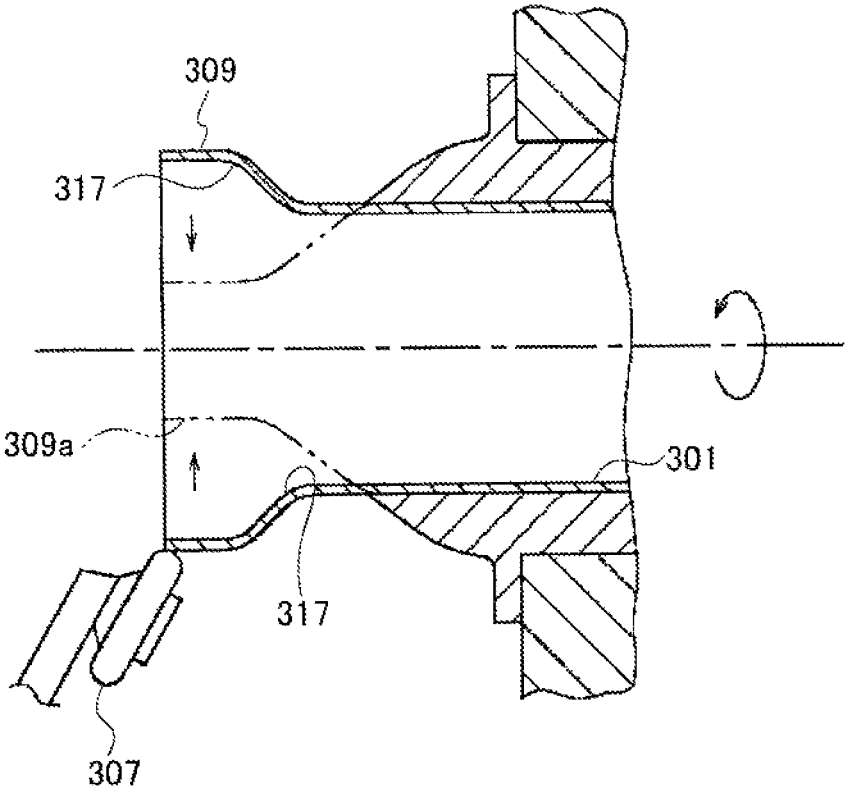
PRIOR ART FIG. 14
FIG. 14 It is a cross-sectional view showing the other forming method (final process).

Necking once formed still remains on a product as a transferred mark that becomes a defect of the product, even after a diameter of the circular hollow cylindrical end portion 309 is reduced by the roller 307 as shown in FIG. 14. The inside roller 11 in the present embodiment has a shape for preventing this defect.

As shown in FIG. 4, the inside roller 11 in the present embodiment includes a solid cylindrical main body 31 and a hemispherical shaped end portion 33. One end (A right end) of the main body 31 is attached to the above-mentioned inside roller mount portion 25. The end portion 33 is provided at another end (a left end) of the main body 31. A diameter of a hemisphere of the end portion 33 and a diameter of the main body 31 are equal to each other, and an entire of a circular surface of the other end of the main body 31 and an entire of a circular flat surface of the end portion 33 are made coherent with each other. Alternatively, the main body 31 and the end portion 33 are formed monolithically.

The inside roller 11 has a smooth outer surface. In a cross-sectional shape (a cross-sectional shape including the center axis) of the inside roller 11, the main body 31 is rectangular and the end portion 33 is semicircular. Except for two corners of the one end (right end) of the main body 31, an inclination of a tangential line at an outline of the cross-sectional shape doesn't change acutely, but changes smoothly.

Figure 9:
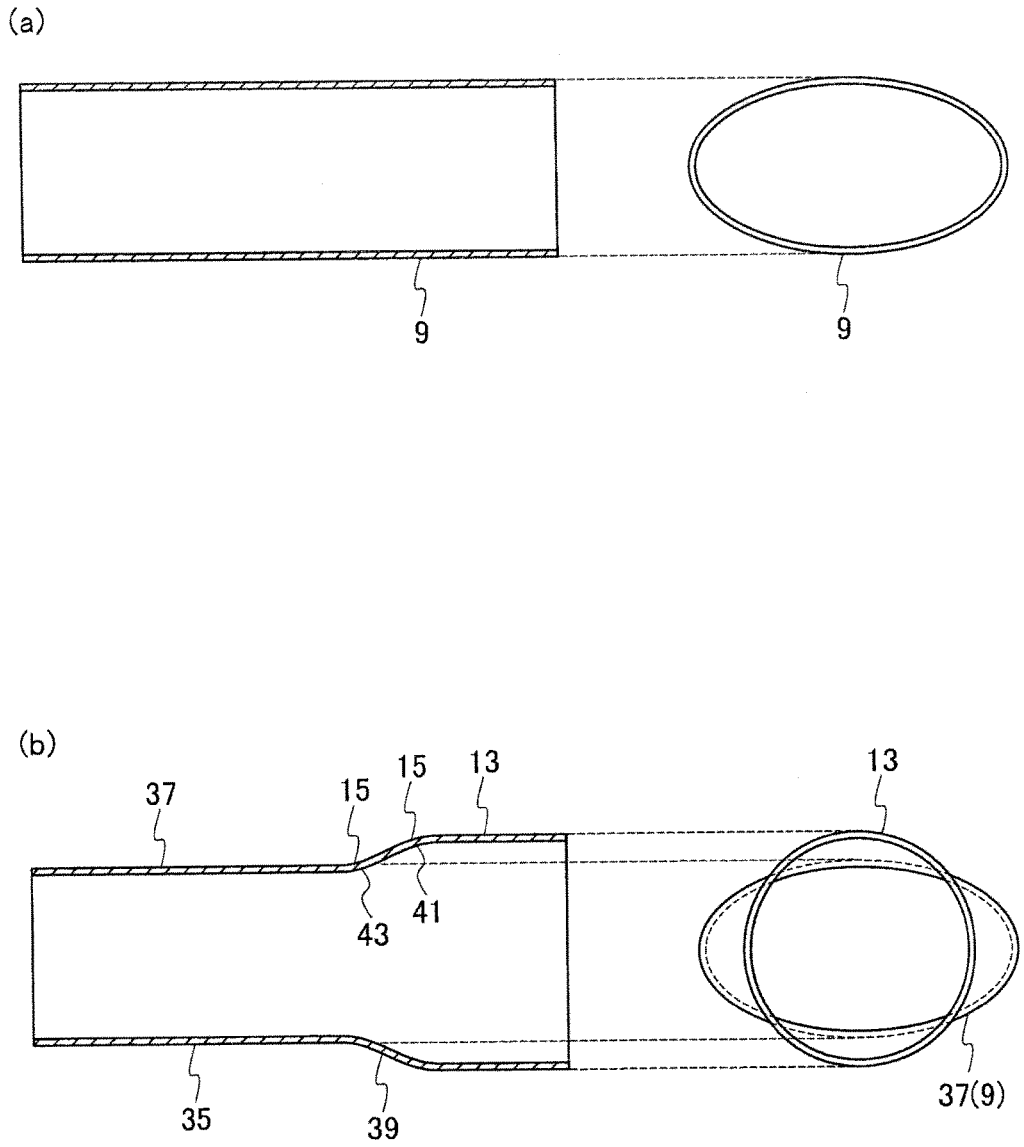
FIG. 9 (*a*) is a cross-sectional view and a front view showing an elliptical hollow cylinder before the first forming process, and (*b*) is a cross-sectional view and a front view showing the elliptical hollow cylinder after the first forming process.

At an end portion of the elliptical hollow cylinder 9 shown in FIG. 9(*a*), the large-diameter circular hollow cylindrical portion 13 shown in FIG. 9(*b*) is formed by the first forming process. In the first forming process, a boundary portion 15 between the large-diameter circular hollow cylindrical portion 13 (the end portion of the elliptical hollow cylinder 9) and a non-deformed portion (portion other than the end portion) 37 is formed so as to be smoothly curved. Note that a diameter of the main body 31 is smaller than a short diameter (an inner diameter) of the elliptical hollow cylinder 9.

An intermediary member 35 in the first forming process shown in FIG. 9(*b*) includes the non-deformed portion 37, an intermediary portion 39 and the large-diameter circular hollow cylindrical portion 13. A center axis of the non-deformed portion 37, a center axis of the intermediary portion 39 and a center axis of the large-diameter circular hollow cylindrical portion 13 are coincident with each other. The non-deformed portion 37, the intermediary portion 39 and the large-diameter circular hollow cylindrical portion 13 are formed along the axial direction in this order.

The non-deformed portion 37 is not processed, and thereby maintains a cross-sectional shape of the elliptical hollow cylinder 9. The large-diameter circular hollow cylindrical portion 13 is formed into a circular hollow cylindrical shape by the inside roller 11. As shown in FIG. 6 and FIG. 9(*b*), an outer diameter of the large-diameter circular hollow cylindrical portion 13 is smaller than a large diameter (an inner diameter) of the elliptical hollow cylinder 9 (the non-deformed portion 37), and larger than a short diameter (an outer diameter) of the elliptical hollow cylinder 9 (the non-deformed portion 37). However, the outer diameter of the large-diameter circular hollow cylindrical portion 13 may be larger than a large diameter (an outer diameter) of the elliptical hollow cylinder 9 (the non-deformed portion 37).

A cross-sectional shape (a shape of a cross-section perpendicular to the axis direction) is changed gradually and smoothly from the non-deformed portion 37 toward the large-diameter circular hollow cylindrical portion 13 so as to shift from a cross-sectional shape of the non-deformed portion 37 to a cross-sectional shape of the large-diameter circular hollow cylindrical portion 13. The boundary portion 15 corresponds to a boundary portion 41 of the large-diameter circular hollow cylindrical portion 13 and the intermediary portion 39. Note that the boundary portion 15 may contain a boundary portion 43 of the intermediary portion 39 and the non-deformed portion 37, and the intermediary portion 39. Namely, the boundary portion 43 and the intermediary portion 39 may be formed so as to be smoothly curved by the inside roller 11 in the first forming process.

Note that the end portion 33 may be formed to have a spherical band shape. Namely, as shown in FIG. 4, a spherical crown portion 45 may be removed from the hemispherical shaped end portion 33. In addition, the end portion 33 may be formed as a half-elliptical solid of revolution. Further, the end portion 33 may be formed as a truncated solid of revolution that is made by removing a crown portion from a half of a solid elliptical sphere.

In the present embodiment, the inside roller 11 includes the end portion 33 as a hemisphere or a half-elliptical solid of revolution, and thereby the boundary portion 15 is smoothly curbed. However, a shape of an outer surface of the inside roller 11 may not be made continuously smooth. For example, as shown in FIG. 10, the end portion 33 of the inside roller 11 may have an outer circumferential surface that changes in a stepwise manner.

Figure 10:
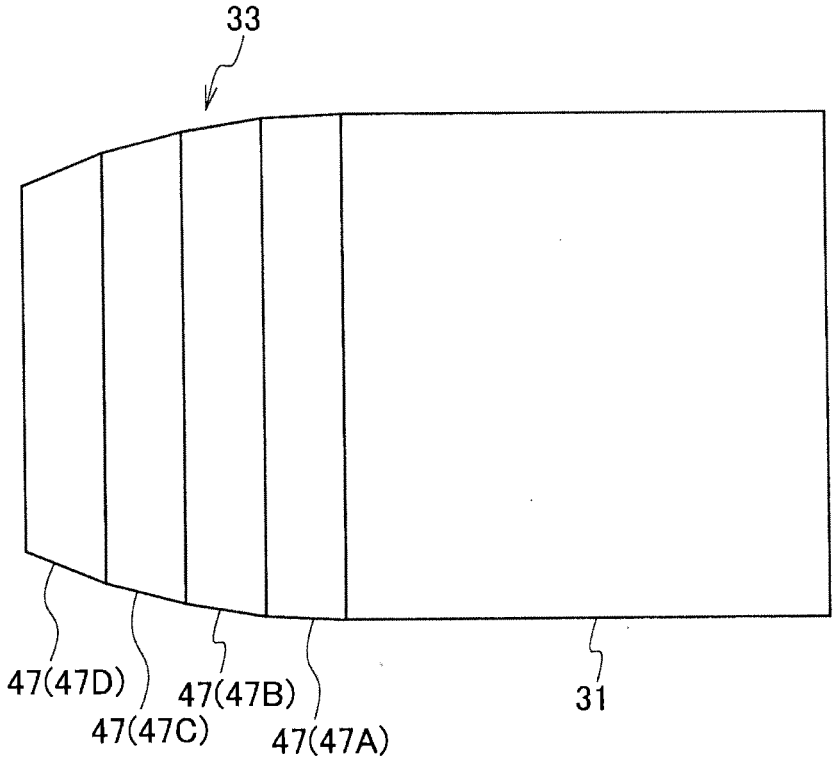
FIG. 10 It is a side view showing a modified example of an inside roller.
Figure 11:
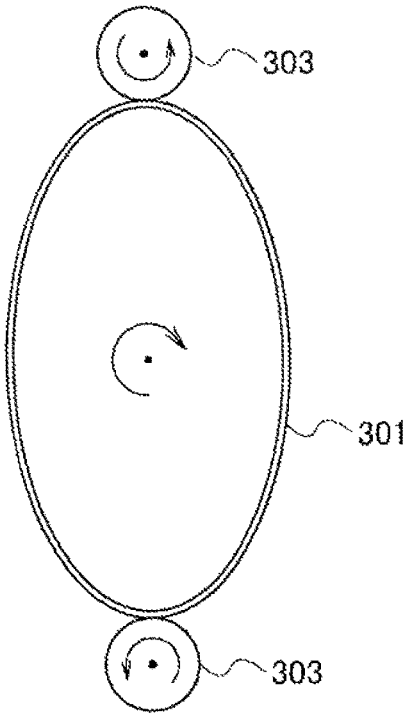
FIG. 11 (*a*) and (*b*) are front views showing a prior-art forming method.
Figure 11:
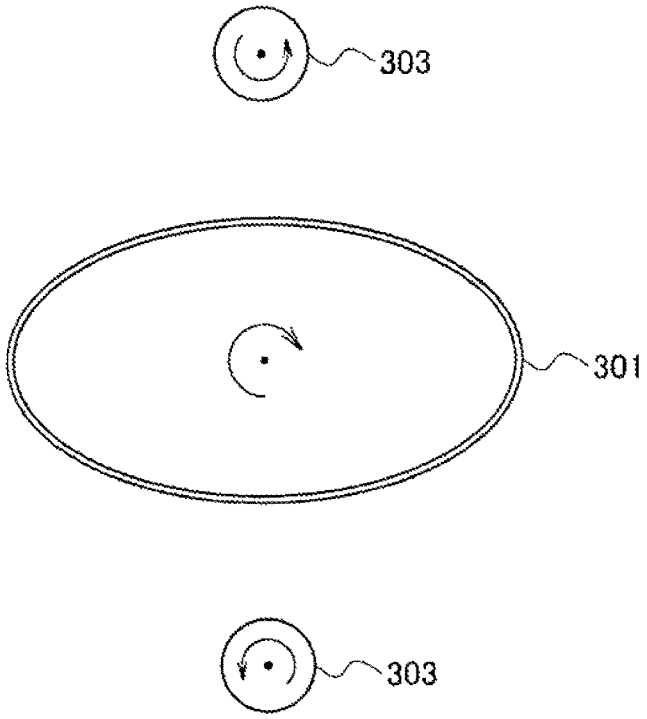

The end portion 33 shown in FIG. 10 has a shape formed by combining plural truncated cones 47 (47A, 47B, 47C 47D). The closer to the main body 31, the smaller a taper (an inclination) of each of the truncated cones 47 (47A, 47B, 47C 47D) becomes (small in the truncated cone 47A). The farther from the main body 31, the larger it becomes (large in the truncated cone 47D).

According to the present embodiment, the large-diameter circular hollow cylindrical portion 13 is formed at the end portion of the elliptical hollow cylinder 9 by the inside roller 11 in the first forming process, and a diameter of the large-diameter circular hollow cylindrical portion 13 is reduced by the outside rollers 17 in the second forming process. Therefore, compared with a prior-art case in which a die is used, it is not needed to transfer the elliptical hollow cylinder 9, and thereby one process can be omitted. As the result, time required for forming can be shortened.

In addition, since a specially-prepared die is not needed for the present embodiment, a cost for making a die and so on is not needed even in a case where a shape of the product 1 (a size or a dimension of the elliptical hollow cylinder 9, a size or a dimension of the end portion 7 of elliptical hollow cylinder 9) is changed. As the result, we can cope with it flexibly at a low cost.

In addition, according to the present embodiment, the end portion of the elliptical hollow cylinder 9 is formed into a circular hollow cylindrical shape in the first forming process in a manner where not a compressive stress but a tensile stress is applied to the end portion of the elliptical hollow cylinder 9, and then a diameter of the end portion formed into the circular hollow cylindrical shape is reduced in the second forming process by sequentially contacting the outside rollers 17 onto the circular hollow cylindrical end portion (the large-diameter circular hollow cylindrical portion 13) of the elliptical hollow cylinder 9. Therefore, a local deformation (buckling) due to a compressive stress never occur even in a case where spinning in the first forming process is done speedily, and thereby time required for forming can be shortened further than a prior-art case where the end portion of the elliptical hollow cylinder 9 would be directly formed into a circular hollow cylindrical shape. As the result, a cost can be reduced, and mass production can be easily achieved.

In addition, since the second forming process is done in parallel with the first forming process (the second forming process is done sequentially to the first forming process) according to the present embodiment, forming by the outside rollers 17 is done immediately after forming by the inside roller 11 to reduce a diameter of the circular hollow cylindrical end portion (the large-diameter circular hollow cylindrical portion 13) of the elliptical hollow cylinder 9 by the outside rollers 17 that follow the inside roller 11 while forming the end portion of the elliptical hollow cylinder 9 into a circular hollow cylindrical shape by the inside roller 11. Namely, with respect to a portion formed into a circular hollow cylindrical shape in the first forming process, its diameter is reduced by the second forming process imperceptibly later than (immediately after) its formation into the circular hollow cylindrical shape. Therefore, the time required for forming can be shortened further.

In addition, since the outside rollers 17 and the inside roller 11 are provided in the single equipment according to the present embodiment, it is not needed to transfer the elliptical hollow cylinder 9 between the processes (when transiting from the first forming process to the second forming process). Therefore, the time required for forming can be shortened further. Further, since an equipment for the first forming process and an equipment for the second forming process are integrated as the single equipment by providing the outside rollers 17 and the inside roller 11 in the single equipment, the time required for forming can be shortened further.

In addition, since the inside roller 11 is longer than the outside roller(s) 17 according to the present embodiment, forming time in the first forming process can be shortened further by lengthening a contact length between the elliptical hollow cylinder 9 and the inside roller 11 in the first forming process.

Further, since the first forming process is done by the inside roller 11 having the hemispherical shaped end portion 33 in the present embodiment, the above-mentioned boundary portion 15 is formed so as to be smoothly curved. Therefore, necking caused by transferring of the ridge line is not generated on the elliptical hollow cylinder 9 (especially on its inner wall) by the first forming process. And then, since a diameter of the end portion formed into a circular hollow cylindrical shape in the first forming process is reduced by the outside rollers 17 in the second forming process, it can be prevented that a defect is generated on the product 1.

In the above-described embodiment, the first forming process is done only by the inside roller 11. However, the end portion of the elliptical hollow cylinder 9 may be formed into a circular hollow cylindrical shape in the first forming process by using the inside roller 11 and the outside rollers 17 concurrently (a second embodiment). Namely, the end portion of the elliptical hollow cylinder 9 may be formed into a circular hollow cylindrical shape in the first forming process by pressing the inside roller 11 onto an inner wall of the end portion of the elliptical hollow cylinder 9 and concurrently pressing the outside rollers 17 onto an outer wall thereof. Here, the inside roller 11 expands the short-diameter portions of the elliptical hollow cylinder 9, and the outside rollers 17 reduce the long-diameter portions of the elliptical hollow cylinder 9. Subsequently, in the second forming process, a diameter of the end portion (the large-diameter circular hollow cylindrical portion 13) formed into a circular hollow cylindrical shape in the first forming process is reduced by the outside rollers 17.

In forming by using the inside roller 11 and the outside rollers 17 concurrently in the first forming process, in a state where the elliptical hollow cylinder 9 is being rotated, the inside roller 11 is moved toward a side of the one end (right side) along the axial direction while being pressed onto an inner wall of the elliptical hollow cylinder 9 (especially, onto the short-diameter portions and vicinities thereof), and the outside rollers 17 are moved toward the side of the one end (right side) along the axial direction while being pressed onto an outer wall of the elliptical hollow cylinder 9 (especially, onto the long-diameter portions and vicinities thereof). Here, the outside rollers 17 move at almost the same speed as that of the inside roller 11, and follow the inside roller 11 while keeping the distance L1 to the inside roller 11 substantially constant.

Note that the inside roller 11 is pressed onto the inner wall of the elliptical hollow cylinder 9, and its pressing area becomes gradually larger as the end portion of the elliptical hollow cylinder 9 is transmuted into a circular hollow cylindrical shape. Similarly, the outside rollers 17 are pressed onto the outer wall of the elliptical hollow cylinder 9, and their pressing area becomes gradually larger as the end portion of the elliptical hollow cylinder 9 is transmuted into a circular hollow cylindrical shape. Note that, before the first forming process, the outside rollers 17 may be located at the same position along the axial direction as that of the inside roller 11, or may be located on the one side (right side) from the inside roller 11 in the axial direction.

In forming by using the outside rollers 17 in the second forming process, the outside rollers 17 are returned to their previous position before the first forming process (or an appropriate position as needed, which is different from the previous position before the first forming process), and then moved toward the one side (right side) along the axial direction while being pressed onto the outer wall of the elliptical hollow cylinder 9.

Note that the second forming process may be done by using another outside roller(s) different from the above-described outside roller (first outside rollers) 17 (a second outside roller(s) provided in the single equipment in which the first outside rollers 17 are also provided: not shown) (a modified example of the second embodiment). In this case, before the first forming process, the second outside roller(s) are located on a side of the other end (left side) along the axial direction, distantly from the inside roller 11 and the first outside rollers 17.

And, in forming by the second outside roller(s) in the second forming process, the second outside roller(s) is moved toward a side of the one end (right side) along the axial direction while being pressed onto the outer wall of the elliptical hollow cylinder 9. Here, the second outside roller(s) moves at almost the same speed as that of the inside roller 11 and the first outside rollers 17, and follows the inside roller 11 and the first outside rollers 17 while keeping a distance to the inside roller 11 and the first outside rollers 17 substantially constant.

Since the end portion of the elliptical hollow cylinder 9 is formed into a circular hollow cylindrical shape by using the inside roller 11 and the outside rollers 17 concurrently in the first forming process in the present embodiment, spinning in the first forming process can be done more speedily. As the result, the time required for forming can be shortened further.

Note that the end portion of the elliptical hollow cylinder 9 is formed by the rollers 11 and 17 in the above embodiments, but it may be formed by a tool for spinning such as a spatula(s) instead of the rollers 11 and 17. In addition, the end portion of the elliptical hollow cylinder 9 is formed in the above embodiments, but another portion(s) of the elliptical hollow cylinder 9 such as its center portion may be formed.

Figure 3:
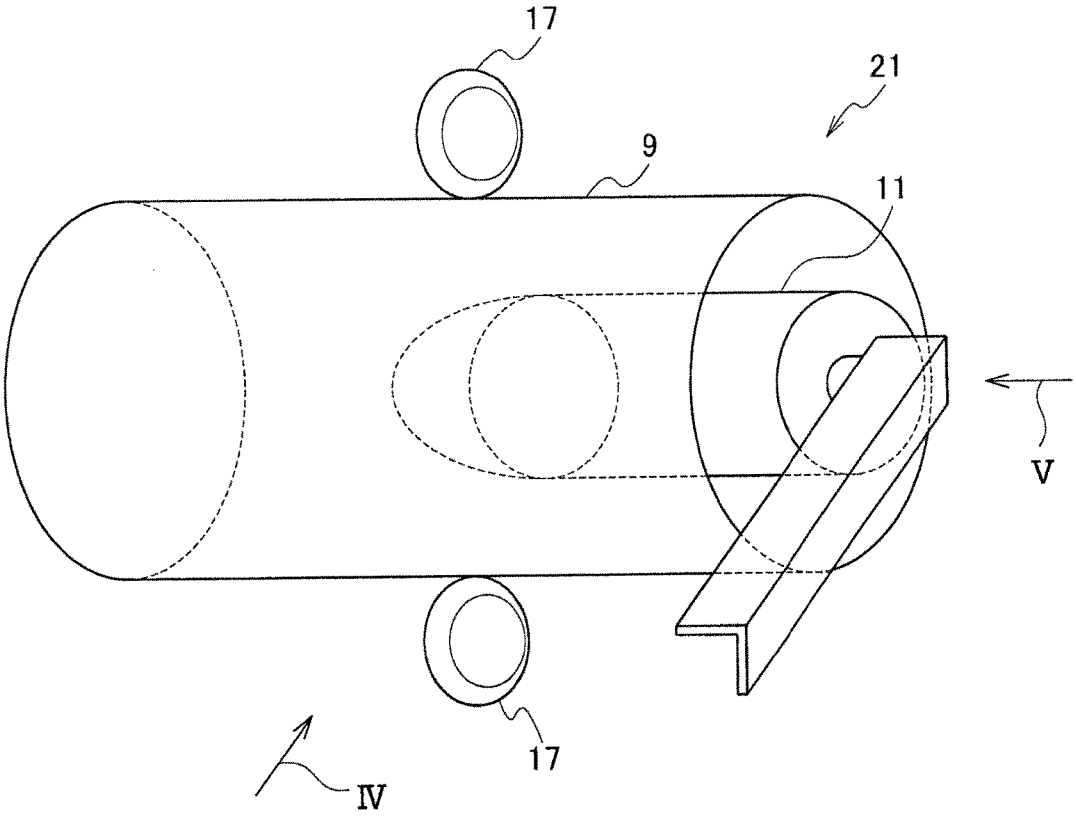
FIG. 3 It is a perspective view showing a schematic configuration of an apparatus for forming an elliptical hollow cylinder according to an embodiment.

As shown in FIG. 3 to FIG. 5, the above-described forming apparatus 21 includes the inside roller 11 and the outside rollers 17. The inside roller 11 is located inside the elliptical hollow cylinder 9, and forms the end portion of the elliptical hollow cylinder 9 into a circular hollow cylindrical shape. The outside rollers 17 are located outside the elliptical hollow cylinder 9, and form the circular hollow cylindrical shape formed by the inside roller 11 into a circular hollow cylindrical shape whose diameter is reduced. In addition, an elliptical hollow cylinder mount portion 23, the inside roller mount portion 25, outside roller mount portions 27 and a controller (not shown) including a CPU are provided in the forming apparatus 21.

The elliptical hollow cylinder 9 mounted on the elliptical hollow cylinder mount portion 23 is rotated about its center axis (rotation). The inside roller 11 mounted on the inside roller mount portion 25 is rotated about its center axis (rotation). The inside roller 11 is movable along a direction perpendicular to the center axis and along the axial direction, and its position can be fixed at an appropriate position. The outside roller(s) 17 mounted on the outside roller mount portion(s) 27 is rotated about its center axis (rotation). The outside roller(s) 17 is movable along a direction perpendicular to the center axis and along the axial direction, and its position can be fixed at an appropriate position.

An extending direction of the center axis of the elliptical hollow cylinder 9 mounted on the elliptical hollow cylinder mount portion 23, an extending direction of the center axis of the inside roller 11 mounted on the inside roller mount portion 25, and an extending direction of the center axis of the outside roller(s) 17 mounted on the outside roller mount portion(s) 27 are the same direction.

In addition, the forming apparatus 21 is controlled by the above-mentioned controller based on an operational program preliminarily stored in a memory of the controller. Here, forming of the product 1 by the rollers 11 and 17 is done sequentially while maintaining a state where the elliptical hollow cylinder 9 is mounted on the elliptical hollow cylinder mount portion 23.

The invention claimed is:

1. A method for forming an elliptical hollow cylinder, by which part of the elliptical hollow cylinder is formed into a contracted circular hollow cylindrical shape by spinning, the method comprising:

a first forming process for forming the part of the elliptical hollow cylinder into an expanded circular hollow cylindrical shape by use of an inside roller, the inside roller being moved in a direction perpendicular to a center axis of the elliptical hollow cylinder in the first forming process; and a second forming process for forming the part into the contracted circular hollow cylindrical shape by reducing a diameter of the part that has already been formed into the expanded circular hollow cylindrical shape in the first forming process by use of an outside roller, wherein the part of the elliptical hollow cylinder is an end portion of the elliptical hollow cylinder, and the inside roller has a portion that forms a boundary portion between the end portion and a portion other than the end portion so as to be smoothly curved.

2. The method for forming an elliptical hollow cylinder according to claim 1, wherein the second forming process is done in parallel with the first forming process.

3. The method for forming an elliptical hollow cylinder according to claim 1, wherein the outside roller is used in the first forming process in addition to the inside roller to form the part of the elliptical hollow cylinder into the expanded circular hollow cylindrical shape by use of the inside roller and the outside roller concurrently.

4. The method for forming an elliptical hollow cylinder according to claim 3, wherein, in the first forming process, the inside roller and the outside roller are moved along an axial direction of the elliptical hollow cylinder, and form short-diameter portions of the elliptical hollow cylinder and vicinities of the short-diameter portions into the expanded circular hollow cylindrical shape.

5. The method for forming an elliptical hollow cylinder according to claim 1, wherein the outside roller is provided in a single equipment in which the inside roller is also provided, and the first forming process and the second forming process are done in the single equipment.

6. The method for forming an elliptical hollow cylinder according to claim 1, wherein the inside roller is longer than the outside roller.

7. The method for forming an elliptical hollow cylinder according to claim 1, wherein a processed area by the outside roller in the second forming process is longer than a processed area by the inside roller in the first forming process.

8. An apparatus for forming an elliptical hollow cylinder, by which part of the elliptical hollow cylinder is formed into a contracted circular hollow cylindrical shape by spinning, the apparatus comprising:

an inside roller configured to be located inside the elliptical hollow cylinder, and to be moved in a direction perpendicular to a center axis of the elliptical hollow cylinder to form the part of the elliptical hollow cylinder into an expanded circular hollow cylindrical shape; and an outside roller configured to be located outside the elliptical hollow cylinder, and to form the part into the contracted circular hollow cylindrical shape by reducing a diameter of the part that has already been formed into the expanded circular hollow cylindrical shape by the inside roller, wherein the part of the elliptical hollow cylinder is an end portion of the elliptical hollow cylinder, and the inside roller has a portion that is configured to form a boundary portion between the end portion and a portion other than the end portion so as to be smoothly curved.

9. The apparatus for forming an elliptical hollow cylinder according to claim 8, wherein the outside roller and the inside roller are disposed along an axial direction of the elliptical hollow cylinder, and are configured to move in the axial direction at the same speed while keeping a constant distance therebetween.

10. The apparatus for forming an elliptical hollow cylinder according to claim 8, wherein, the inside roller and the outside roller are configured such that when the inside roller forms the part of the elliptical hollow cylinder into the expanded circular hollow cylindrical shape, the outside roller also forms the part of the elliptical hollow cylinder into the expanded circular hollow cylindrical shape.

11. The apparatus for forming an elliptical hollow cylinder according to claim 10, wherein the inside roller and the outside roller are movable along an axial direction of the elliptical hollow cylinder, and are configured to form short-diameter portions of the elliptical hollow cylinder and vicinities of the short-diameter portions into the expanded circular hollow cylindrical shape.

12. The apparatus for forming an elliptical hollow cylinder according to claim 8, wherein the inside roller is longer than the outside roller.

13. The apparatus for forming an elliptical hollow cylinder according to claim 8, wherein a processed area by the outside roller is longer than a processed area by the inside roller.

* * * * *